US007871215B2

(12) United States Patent
Collings

(10) Patent No.: US 7,871,215 B2
(45) Date of Patent: Jan. 18, 2011

(54) RECONFIGURABLE MAILING MACHINE FOR PRINTING AND OPENING MAILPIECES

(75) Inventor: Peter T. Collings, Shelton, CT (US)

(73) Assignee: Pitney Bowes Inc., Stamford, CT (US)

( * ) Notice: Subject to any disclaimer, the term of this patent is extended or adjusted under 35 U.S.C. 154(b) by 693 days.

(21) Appl. No.: 11/832,937

(22) Filed: Aug. 2, 2007

(65) Prior Publication Data

US 2009/0031903 A1 Feb. 5, 2009

(51) Int. Cl.
*B41J 11/68* (2006.01)
*B41J 11/66* (2006.01)

(52) U.S. Cl. ..... 400/621.1; 400/621; 53/381.3

(58) Field of Classification Search ..... 400/621, 400/621.1; 53/381.3; 101/91
See application file for complete search history.

(56) References Cited

U.S. PATENT DOCUMENTS

| | | | | |
|---|---|---|---|---|
| 6,064,995 | A * | 5/2000 | Sansone et al. | 705/410 |
| 7,231,859 | B2 * | 6/2007 | Lawrence | 83/508.1 |
| 2004/0218958 | A1 * | 11/2004 | Kruger et al. | 400/103 |
| 2008/0079770 | A1 * | 4/2008 | Sloan et al. | 347/29 |

FOREIGN PATENT DOCUMENTS

| | | | |
|---|---|---|---|
| JP | 2004074544 A | * | 3/2004 |

* cited by examiner

*Primary Examiner*—Daniel J Colilla
(74) *Attorney, Agent, or Firm*—Brian A. Collins; Angelo N. Chaclas

(57) ABSTRACT

A mailing machine for processing mailpiece envelopes, wherein a print station thereof is reconfigurable to process envelopes in two operating modes. The reconfigurable print station includes a displacement device having an integrated cutting mechanism to perform both printing and cutting operations. The displacement device includes a displacement surface for urging the mailpiece envelopes against a registration surface to facilitate print operations and a cutting mechanism coupled to the displacement device for cutting the sheet material in a direction substantially parallel to the processing path of the mailpiece envelope. The cutting device is adapted to be repositioned relative to the displacement surface such that, (i) in a first operating mode, the cutting device is retracted beneath or below the plane of the displacement surface, and (ii) in a second operating mode, the cutting device is extended above the plane of the displacement surface to cut the sheet material as it traverses the processing path. In the first operating mode, the print station is adapted to print delivery information/images, such as postage indicia, on a face surface of the mailpiece and, in the second operating mode, the print station is adapted to cut an edge of the mailpiece to open the envelope. The print heads may remain operational in the second operating mode to print mailpiece opening information such as the date, time, and/or location of mailpiece processing.

16 Claims, 10 Drawing Sheets

RECONFIGURABLE MAILING MACHINE FOR PRINTING AND OPENING MAILPIECES

FIELD OF THE INVENTION

The invention disclosed herein relates to mailing systems, and more particularly to a system and method for reconfiguring a mailing system for printing and opening a mailpiece envelope.

BACKGROUND OF THE INVENTION

Mailing systems, such as, for example, a mailing machine, often include a variety of modules to automate processes associated with producing a mailpiece. Other systems, such as, for example, a mailpiece opener, are dedicated to a single operation, such as opening a sealed envelope. Whether automating a single operation or combining several, these mailing systems typically improve efficiency by minimizing the labor associated with feeding, filling or removing content material from an envelope.

A typical mailing machine includes a variety of different modules or stations each of which performs a dedicated task. A mailpiece may be conveyed downstream utilizing a transport mechanism, such as rollers or a belt, to each of the stations or modules. These stations/modules may include, inter alia: (i) a feeding station, (ii) a moistening/sealing module, (iii) a weighing station and (iv) a print station.

The feeding station typically includes a singulator which receives stacked mailpieces and singulates/separates the lowermost mailpiece from a stack of mailpieces. As the mailpieces are conveyed along the processing path, the lowermost mailpieces are shingled through a pair of belts which, in cross section, resemble a shallow-V configuration. At the vertex formed by the belts, a small gap enables a single mailpiece to pass or separate from the mailpiece stack.

The moistening/sealing module/assembly typically includes a structure for deflecting a flap of an envelope away from the body of the envelope to facilitate the moistening and sealing operations. The deflecting structure often includes a blade that is interposed between the flap and the body, i.e., to separate the flap from the body, as the envelope traverses the transport deck. Once the flap has been separated, the moistener wets the glue line of the flap in preparation for sealing the envelope. One type of moistening system, known as a contact moistening system, deposits a moistening fluid, such as, for example, water or water with a biocide, onto the glue line of the flap by contacting the glue line with a wetted applicator.

The weighing station typically includes a plurality of rollers disposed through a deck which is supported by a load cell. As mailpieces are conveyed along the processing path, i.e., along the deck, each mailpiece is momentarily paused so that the load cell has an opportunity to obtain an accurate weight measurement. After a short settling period, the weight measurement is obtained for calculating a postage value for mail delivery.

At the print station, mailpieces are passed under a registration plate having an opening there through for print heads to access the face surface of the mailpiece. Depending upon the thickness of the mailpiece, a displacement ski is disposed under the mailpiece to press or urge the face surface of the mailpiece against the registration plate and around the opening. As such, a planar face surface is produced to enhance the print quality of information/images, e.g., postage indicia, printed on the mailpiece.

A mailpiece opener, on the other hand, typically includes dedicated cutting blades disposed proximal to a registration wall which guides the mailpiece past the cutting blades. The cutting blades are typically enclosed in a channel and protrude from a top and bottom surface thereof. As the mailpiece is fed through the channel, angled conveyor nips drive the mailpiece against the registration wall and through the cutting blades. The cutting blades remove a thin strip of material, typically along the top edge of the mailpiece and, as such, the mailpiece is opened to access the mailpiece content material.

Inasmuch as certain stations of a conventional mailing machine, e.g., the moistening/sealing module, are, seemingly, at cross-purposes with cutting/opening blades of a mailpiece opener, it will be appreciated that these devices/modules have not, heretofore, been integrated into a single device. That is, inasmuch as one module/assembly closes a mailpiece while the other opens the envelope, it has been common to offer a moistener/sealing module on machines which fabricate mailpieces and cutting blades on machines which open mailpieces. As such, mail service providers must invest, maintain and incur the cost of two separate devices/machines.

A need, therefore, exists for a mailing machine which may be reconfigured to perform both mailpiece closing and opening operations.

SUMMARY OF THE INVENTION

A mailing machine is provided for processing mailpiece envelopes wherein a print station thereof is reconfigurable to process envelopes in two operating modes. The reconfigurable print station includes a displacement device having an integrated cutting mechanism to perform both printing and cutting operations. The displacement device includes a displacement surface for urging the mailpiece envelopes against a registration surface to facilitate print operations and a cutting mechanism coupled to the displacement device for cutting the sheet material in a direction substantially parallel to the processing path of the mailpiece envelope. The cutting device is adapted to be repositioned relative to the displacement surface such that, (i) in a first operating mode, the cutting device is retracted beneath or below the plane of the displacement surface, and (ii) in a second operating mode, the cutting device is extended above the plane of the displacement surface to cut the sheet material as it traverses the processing path. In the first operating mode, the print station is adapted to print delivery information/images, such as postage indicia, on a face surface of the mailpiece and, in the second operating mode, the print station is adapted to cut an edge of the mailpiece to open the envelope. Furthermore, the print heads may remain operational in the second operating mode to print mailpiece opening information such as the date, time and/or location of mailpiece processing.

DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding components/parts.

DETAILED DESCRIPTION OF THE PRESENT INVENTION

The present invention will be described in the context of a mailing machine having many independent modules/assemblies including, for example, singulating, printing, weighing and metering modules. It should be appreciated that these modules/assemblies may or may not be integrated in the same manner as shown or described or in the same sequence of operation. At minimum, however, the invention contemplates a device for processing mailpieces which feeds envelopes to modules or stations which (i) seal/close a mailpiece envelope, (ii) cut/open the mailpiece envelope and (iii) print postage indicia on a face of the envelope.

Figure 1:
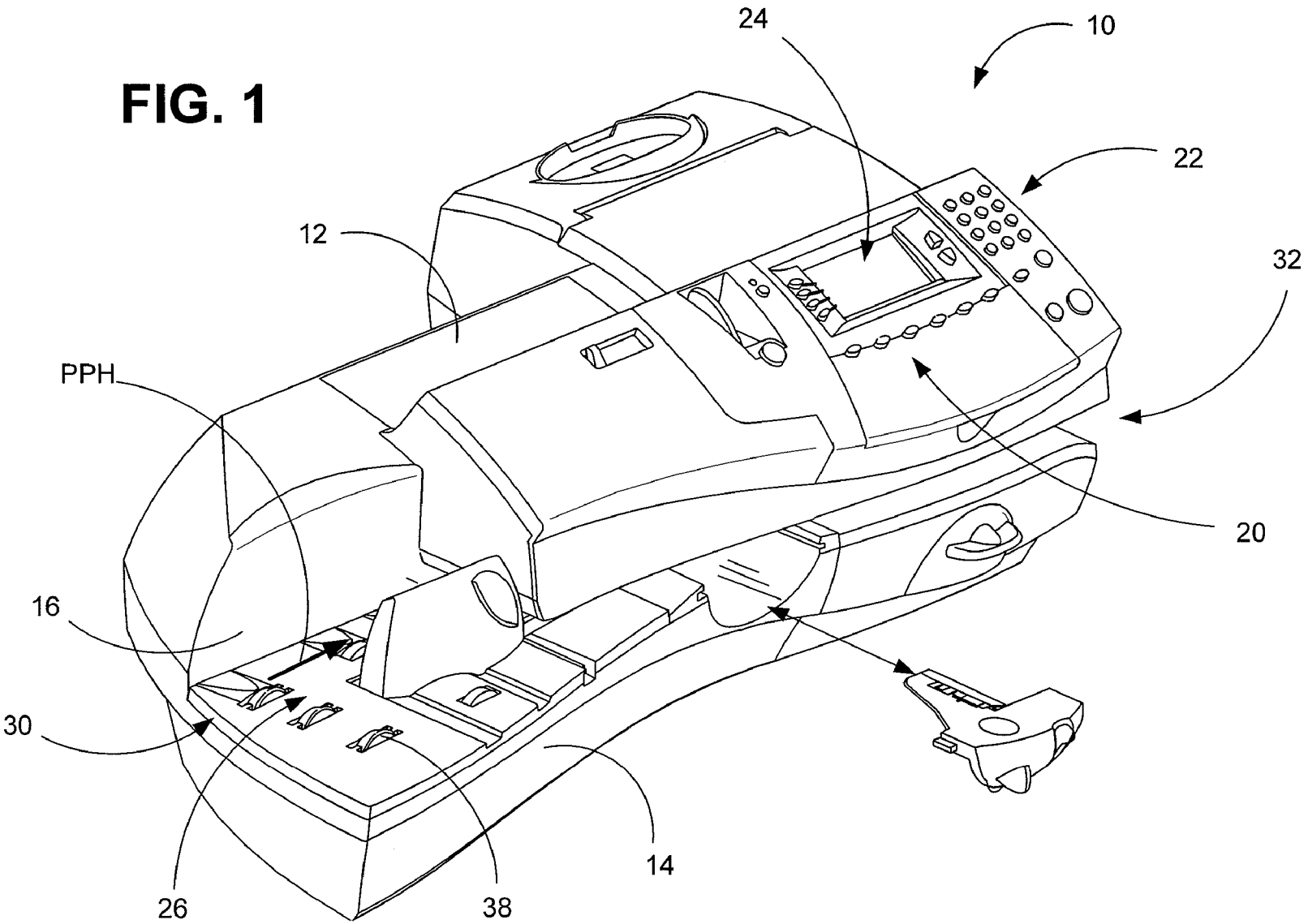
FIG. 1 is a perspective view of a reconfigurable mailing machine according to the present invention.

In describing the present invention, reference is made to the drawings, wherein there is seen in FIG. 1, a reconfigurable mailing machine 10 according to one embodiment of the present invention, includinges a housing 12 having a base designated generally by the reference numeral 14 and a registration wall 16. A control unit 20 is mounted on the housing 12, and includes one or more input/output devices, such as, for example, a keyboard 22 and a display device 24.

The base 14 further includes a horizontal feed or transport deck 26 for feeding mailpieces in succession along a processing path PPH from an input end 30 to an output end 32 of the deck 26. A plurality of rollers 38 are suitably mounted under the transport deck 26 and project upwardly through openings therein so that the periphery of the rollers 38 extends slightly above the upper surface of the feed deck 30 so as to provide a forward feeding force on a succession of mailpieces placed in the input end 30. The registration wall 16 defines a mail piece registration surface which is substantially perpendicular to the transport deck 26 and which extends substantially from the input end 30 to the output end 32 of the transport deck 26.

Figure 2:
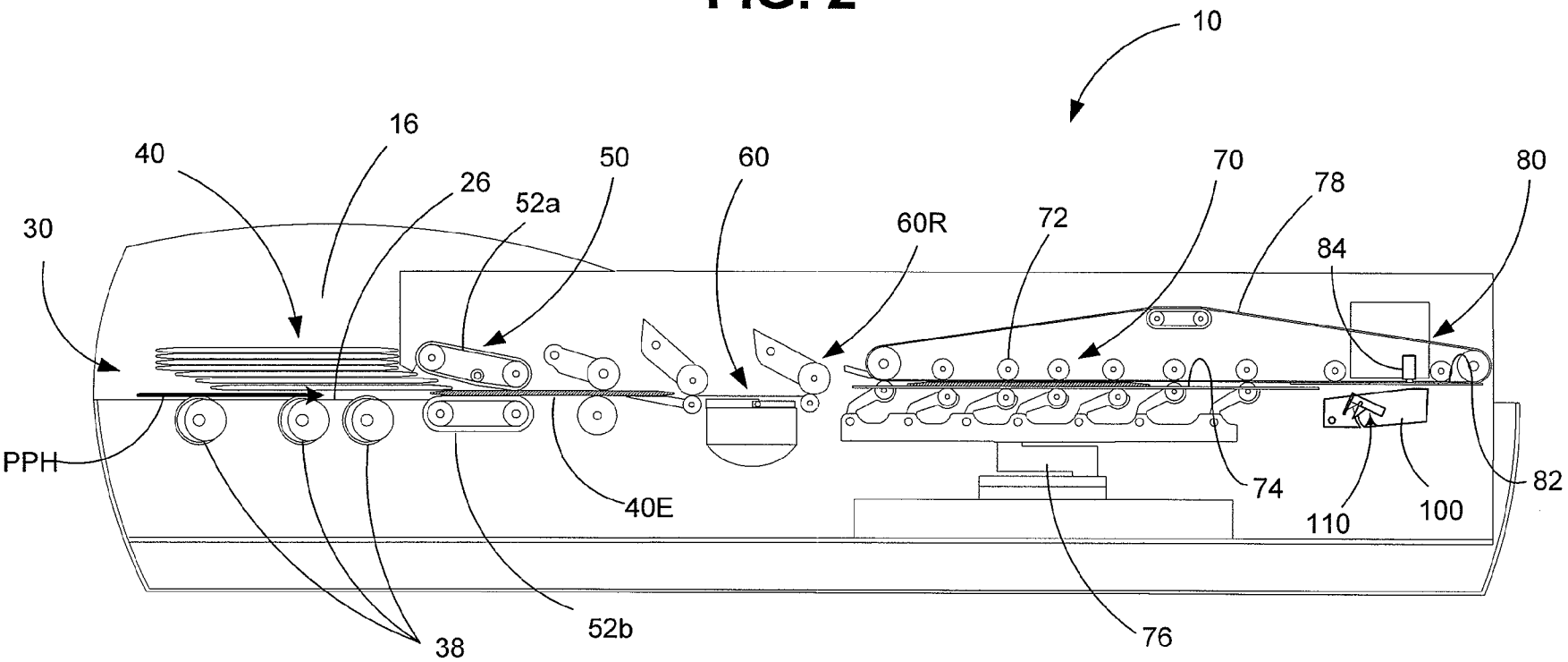
FIG. 2 is a broken away front view of the mailing machine for revealing the various modules/stations of a mailing machine.

In FIGS. 1 and 2, a stack of mailpieces 40 (see FIG. 2) are placed in the input end 30 of the mailing machine 10 and are fed by the rollers 38 along the transport deck 26, with a top edge of the mailpieces 40 being disposed against the registration wall 16. The mailpieces 40 are fed along the processing path PPH to various stations/modules including a singulator 50, a moistening module 60, a weighing station 70 and a print station 80. The singulator 50 receives the stack of mailpieces 40 and singulates/separates the lowermost mailpiece from the stack. As the mailpieces 40 are driven along the processing path, the lowermost mailpieces are shingled through a pair of belts 52*a*, 52*b* which, in cross section, define a shallow-V configuration. At the vertex formed by the belts 52*a*, 52*b* a small gap enables a single mailpiece to pass or separate from the mailpiece stack.

Figure 3:
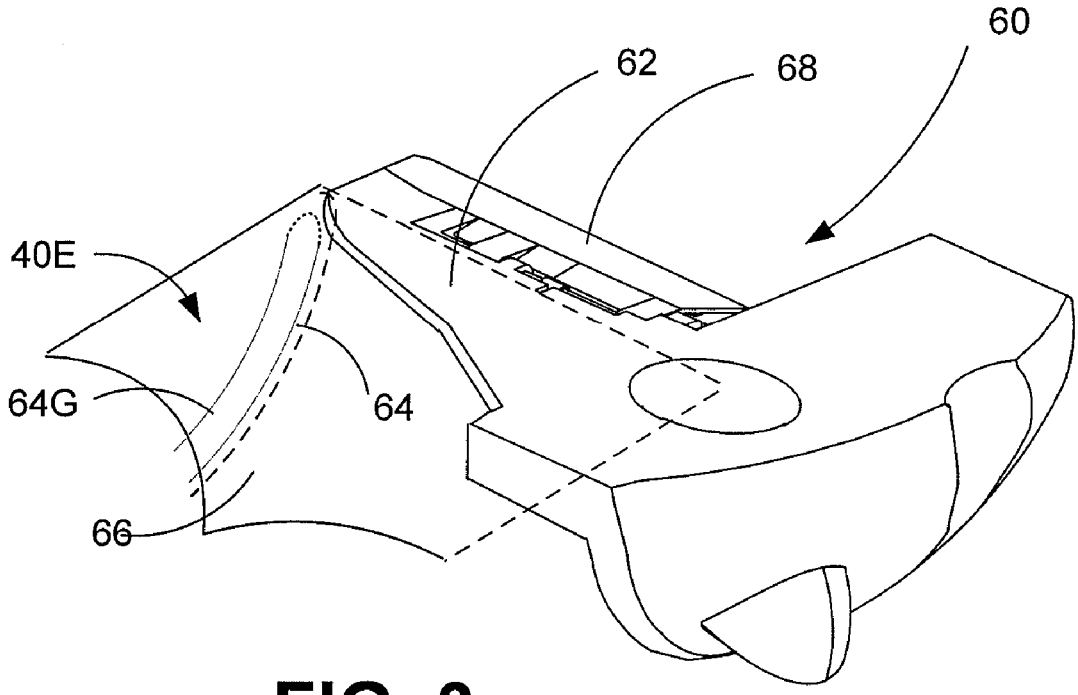
FIG. 3 is a broken away perspective view of a moistening/sealing module employed in a mailing machine.

In FIGS. 1, 2 and 3, the moistening/sealing module 60 (best shown in FIG. 3) includes a blade 62 (FIG. 3 only) for deflecting a flap 64 of an envelope 40E away from the envelope's body 66 to enable the moistening and sealing process to occur. The deflecting blade 62 is interposed between the flap 64 and the body 66 of the envelope 40E, i.e., to separate the flap 64 from the body 66, as the envelope 40E traverses the transport deck. Once the flap 64 has been separated, the moistener 60 wets the line of glue 64G on the flap 64 in preparation for sealing the envelope 40E. One type of moistening system, known as a contact moistening system, deposits a moistening fluid, such as, for example, an aqueous solution of water with a biocide (anti-bacterial agent), onto the glue line 40G of the flap 64 by contacting the line of glue 64 with a wetted applicator 68. That is, as the flap 64 and glue 64 passes the blade 62, the applicator 68 wipes and wets the glue 64 along its length. Thereafter, sealing rollers 60R (see FIG. 2) apply pressure to the glue line 64 to close/seal the envelope 40E.

The weighing station 70 typically includes a plurality of rollers 72 disposed through a deck 74 which are supported by a load cell 76. A conveyor system 78 is suspended above the deck 74 to transport the mailpieces 40 belt along the processing path PPH, i.e., along the deck 74. As mailpieces 40 are conveyed along the processing path PPH, they are momentarily paused so that the load cell 76 can obtain an accurate weight measurement. After a short settling period, a weight measurement is obtained for calculating a postage value for mail delivery.

Figure 4A:
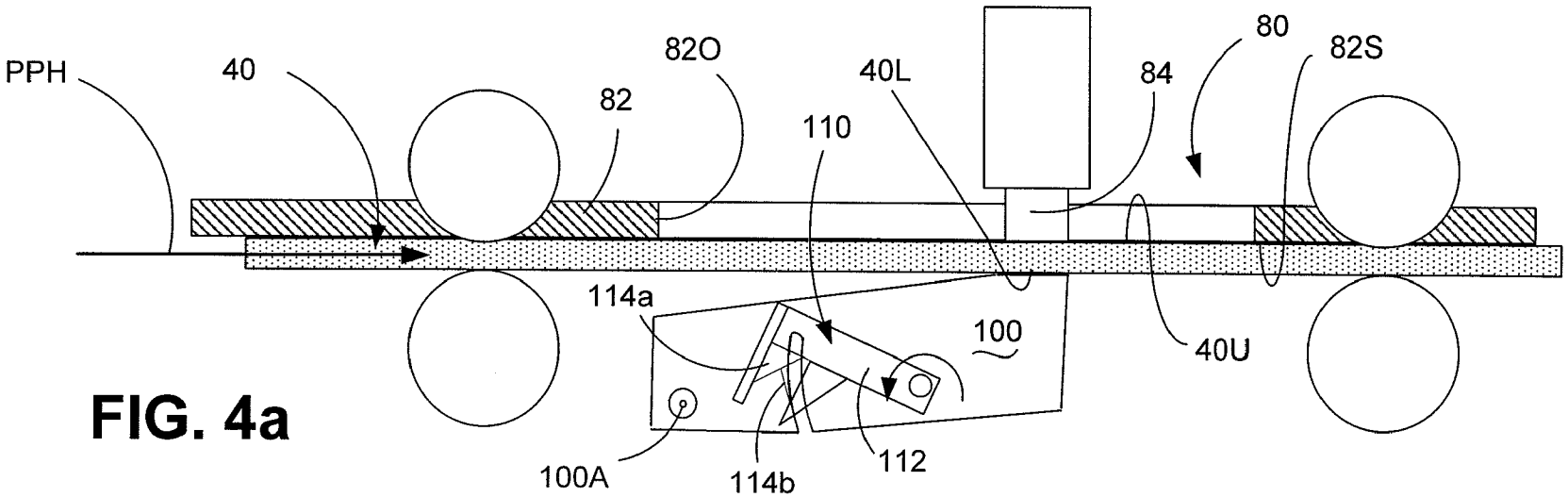
FIG. 4*a* is a schematic side view of a print station for a mailing machine in a first operating mode, wherein a displacement ski urges a mailpiece upwardly against a registration plate to generate a planar surface during print operations.

At the print station 80, shown in FIGS. 2 and 4*a*, mailpieces 40 are passed under a registration plate 82 having an opening 82O (FIG. 4*a*) therein to allow one or more print heads 84 access to the upper face surface 40U of the passing mailpiece 40. That is, the print heads 84 pass through the opening 82O to print postage indicia on the face surface 40U of the mailpiece 40. Furthermore, one or more displacement skies 100 are disposed under the mailpiece 40 to press or urge the face surface 40U thereof against a lower registration surface 82S of the plate 82. Moreover, each displacement ski 100 is pivotable to accommodate mailpieces of varying thickness. Functionally, the displacement ski 100, in combination with the registration plate 82, presents a planar surface to the print heads 84 to enhance print efficacy (i.e., the quality of the printed postage indicia).

In accordance with the present invention, the mailing machine 10 is reconfigurable such that, in a first operating mode, a first print operation is performed associated with printing delivery information e.g., postage indicia, destination address, return address etc., on the upper face surface 40U of the mailpiece 40 and, in a second operating mode, an edge 40D of the mailpiece envelope 40E may be severed to open the mailpiece 40. Furthermore, the mailing machine 10 may be configured such that in the second operating mode, the print heads 84 remain operational to perform a second print operation associated with mailpiece receipt information such as the date and time that the envelope was opened. Additional mailpiece receipt information may also be printed such as information pertaining to the station and/or location where the mailpiece was processed/opened.

Figure 4B:
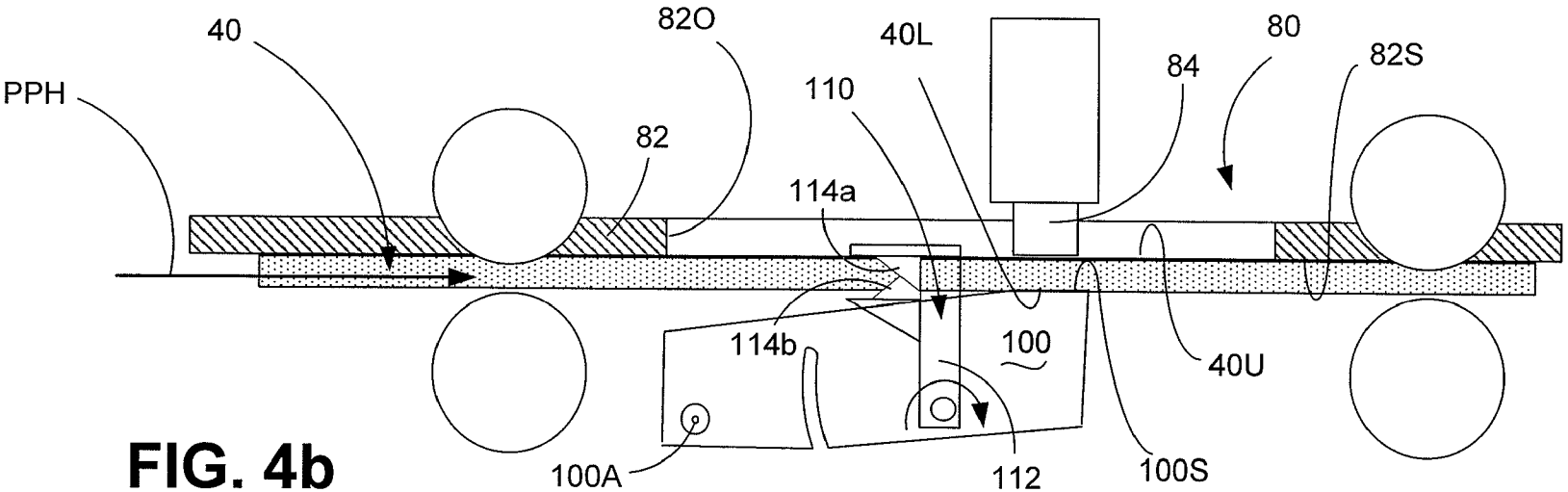
FIG. 4*b* is a schematic side view of the print station, in a second operating mode, wherein a cutting device is pivotably mounted to the displacement ski and wherein the cutting device has been rotated to an extended position to sever an edge of the mailpiece during cutting operations.

In FIGS. 4*a* and 4*b*, the print station 80 has been enlarged to view the mailpiece 40 and displacement ski 100 in greater detail. More specifically, a displacement device 100 includes a displacement surface 100S for urging the mailpiece 40 against a lower registration surface 82S of the registration plate 82. A cutting device 110 is disposed in combination with the displacement ski 100 and, in the embodiment shown, is pivotally mounted along a side of the displacement ski 100, i.e., interposed between the registration wall 16 and the displacement ski 100.

The cutting device 110 may have a variety of configurations and in the described embodiment, the cutting device 110 includes a rectangular shaft or post 112 for mounting a pair of cutting blades 114*a*, 114*b*. The cutting blades 114*a*, 114*b* form a V-shape and have an opening defined by the length of the cutting blades 114*a*, 114*b* and the vertex angle thereof. In the illustrated embodiment, the cutting device 110 may be repositioned to and from (i) a retracted position, below a plane defined by the displacement surface 100S, and (ii) an extended position, above the displacement surface 100S. The means for repositioning the cutting device 110 may include a variety of mechanisms for extending and/or retracting the cutting blades 114*a*, 114*b* into and/or out of its operational position. Two embodiments of such repositioning means will be discussed in greater detail below, however, at this juncture, a brief description the first and second operating modes will be described.

Referring again to FIG. 4*a*, the cutting device 110 is positioned/retracted below the plane of the displacement surface 100S to permit uninterrupted or unencumbered flow of mailpieces 40 along the processing path PPH. In this operating mode, the displacement ski 100 operates in a conventional manner by urging mailpieces 40 against the registration plate 82. More specifically, the displacement ski 100 applies an upward force against the lower mailpiece surface 40L to press the opposing upper mailpiece surface 40U against the registration surface 82S. Furthermore, the displacement ski 100 is pivot mounted about an axis 100A, to facilitate the passage of mailpieces 40 which may vary in thickness. That is, the pivot mount enables the displacement surface 100S to move up or down, i.e., rise and fall, depending upon the thickness of each passing mailpiece 40 (mailpiece thickness can vary from the thickness of a conventional double-sided envelope to as much as three-quarter (¾) inches). As mailpieces 40 pass between the displacement ski 100 and the print head(s) 84, various information/images may be printed on the upper face 40U of the mailpiece 40 including the postage indicia, two-dimensional barcode, return address, destination address, etc.

Figure 5G:
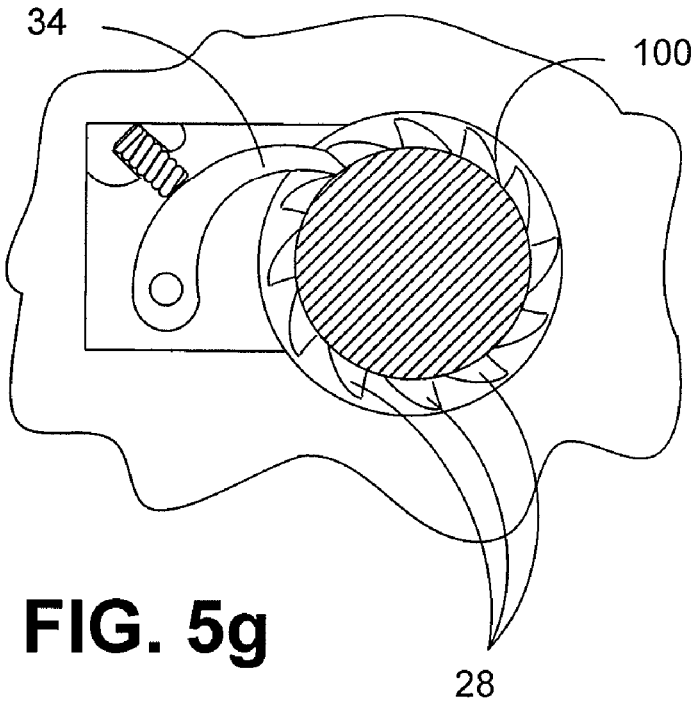
FIG. 5*g* is a sectional view taken substantially along line 5*g*-5*g* of FIG. 5*d* illustrating a ratchet pawl and ratchet teeth for maintaining the rotation position of the actuation shaft when the cutting device has been rotated to an extended position.
Figure 5A:
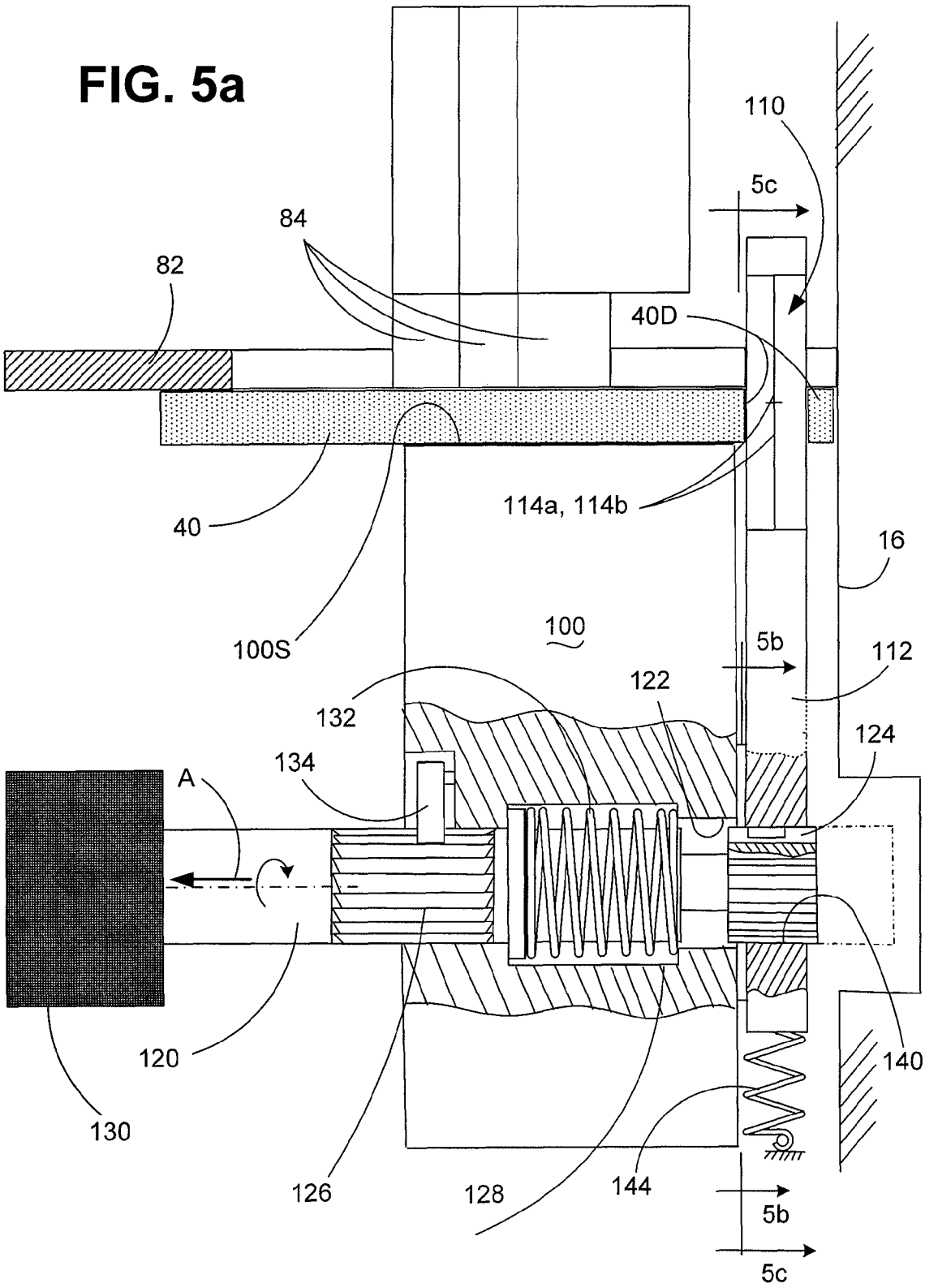
FIG. 5*a* is a partially broken away rear view of the cutting device in combination with the displacement ski wherein the cutting device is mounted to an actuation shaft which may be (i) rotated to extend the cutting device relative a displacement surface of the ski and (ii) depressed axially to retract the cutting device relative to the displacement surface.

In FIGS. 4*b* and 5*a*, the cutting device 110 is positioned/extended above the plane of the displacement surface 100S to permit cutting operations. More specifically, mailpieces 40 are cut along an edge 40D (FIG. 5*a*), e.g., the top edge 40D, parallel to the processing or feed path PPH. Inasmuch as the cutting blades 114*a*, 114*b* are interposed between the displacement ski 100 and the registration wall 16, the mailpiece 40 will necessarily be severed along the edge 40D which lies adjacent the registration wall 16. It will be appreciated, however, that the severed edge 40D, i.e., along the top, bottom or side of the mailpieces 40, will depend on the initial orientation of the mailpieces 40, i.e., as they are loaded onto the mailing machine 10.

Figure 5B:
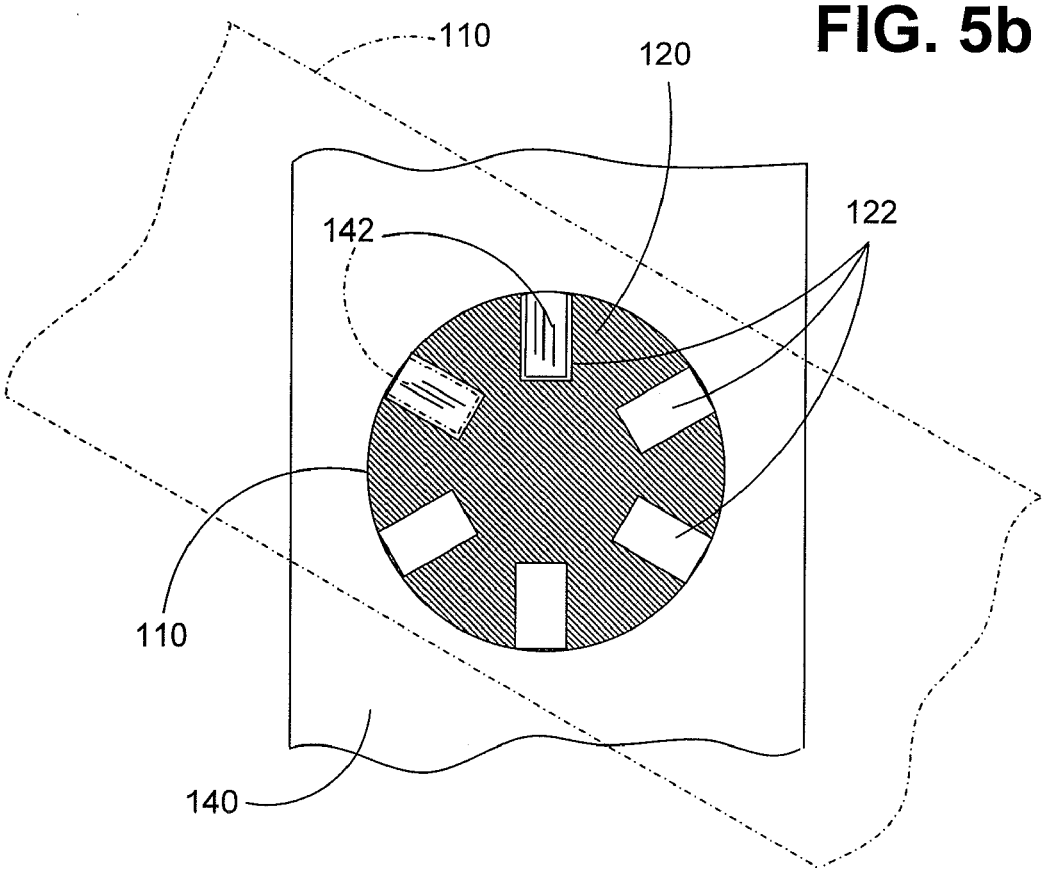
FIG. 5*b* is a sectional view taken substantially along line 5*b*-5*b* of FIG. 5*a* illustrating a means for rotationally coupling the cutting device to the actuation shaft wherein the cutting device includes at least one key or tooth engaging an axial groove or keyway in the actuation shaft.

The means for repositioning the cutting device 110 may include mechanisms which rotate the cutting blades 114*a*, 114*b* into and out of the extended/retracted positions, or devices which linearly raise/lower the cutting device 110 blades 114*a*, 114*b* into extended/retracted positions. In FIGS. 5*a* and 5*b*, an actuation shaft 120 extends through a cylindrical opening 122 within the displacement ski 100 to engage the cutting device 110. More specifically, the actuation shaft 120 includes a plurality of axial grooves 124 disposed about the periphery of the shaft 120 at one end, a plurality of ratchet teeth 126 disposed about the shaft 120 at a medial portion thereof, and a circumferential groove 128 disposed between the axial grooves 124 and the ratchet teeth 126. Furthermore, the terminal end of the shaft 120 includes a knurled knob 130 for applying loads to the shaft 120 in operation.

The cylindrical opening 122 of the displacement ski 100 accommodates an internal coil spring 132 for axially biasing the actuation shaft 120 outwardly in the direction of arrow A. Furthermore, the displacement ski 100 includes a ratchet pawl 134 for engaging the ratchet teeth 126 to restrict rotational motion of the shaft in one direction, i.e., in a counterclockwise direction, while accommodating rotation in an opposing direction, i.e., in a clockwise direction.

Figure 5C:
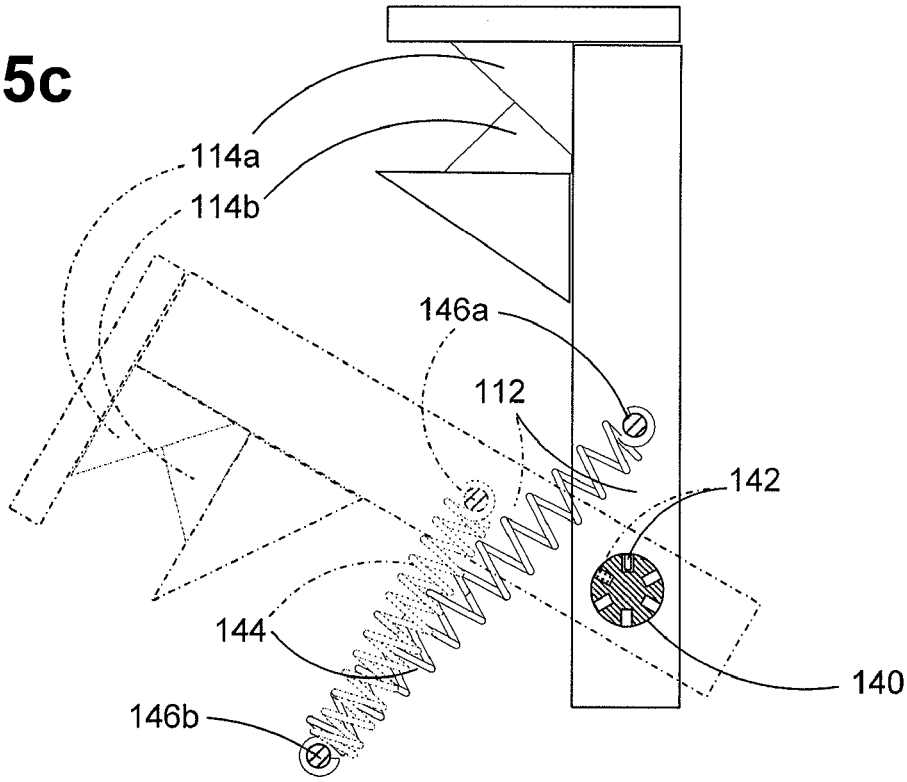
FIG. 5*c* is a sectional view taken substantially along line 5*c*-5*c* of FIG. 5 illustrating a means for retaining the rotational position of the cutting device relative to the actuation shaft against the force of a biasing device tending to rotate the cutting device to a retracted position.

In FIGS. 5*b* and 5*c*, the rectangular post 112 of the cutting device 110 includes an aperture 140 for accepting an end of the actuation shaft 120 and a small tooth or key 142 projecting inwardly from the aperture 140 for accepting one of the axial grooves 124 of the actuation shaft 120. In FIG. 5*c*, an elongate coil spring 144 is disposed between the post 112 and the displacement ski 100 to rotationally bias the cutting device 110 about the actuation shaft 120. In the described embodiment, the coil spring 144 is mounted to the post 112 via a pin 146*a* between the aperture 140 and the cutting blades 114*a*, 114*b*. Furthermore, the mounting pins 146*a*, 146*b* permit relative rotation between the coil spring 144, the post 112 and the displacement ski 100.

In its extended position, the rectangular post 112 is upright to position the cutting blades 114*a*, 114*b* above the plane of the displacement surface 110S (see FIG. 5*a*). With the rectangular post 112 in its upright position, the elongate coil spring 144 (best seen in FIG. 5*c*) is under tension, i.e., against a biasing force tending to rotate the cutting device 110 to its retracted position. Furthermore, the aperture key 142 (FIG. 5*b*) is disposed within an axial groove 124 of the actuation shaft 120 while the ratchet pawl 134 (FIG. 5*a*) engages the ratchet teeth 126 to prevent rotation of the actuation shaft 120. With respect to the latter, the ratchet pawl 134 retains the upright position of the cutting device 110 against the spring bias force of the elongate coil spring 144.

Figure 5D:
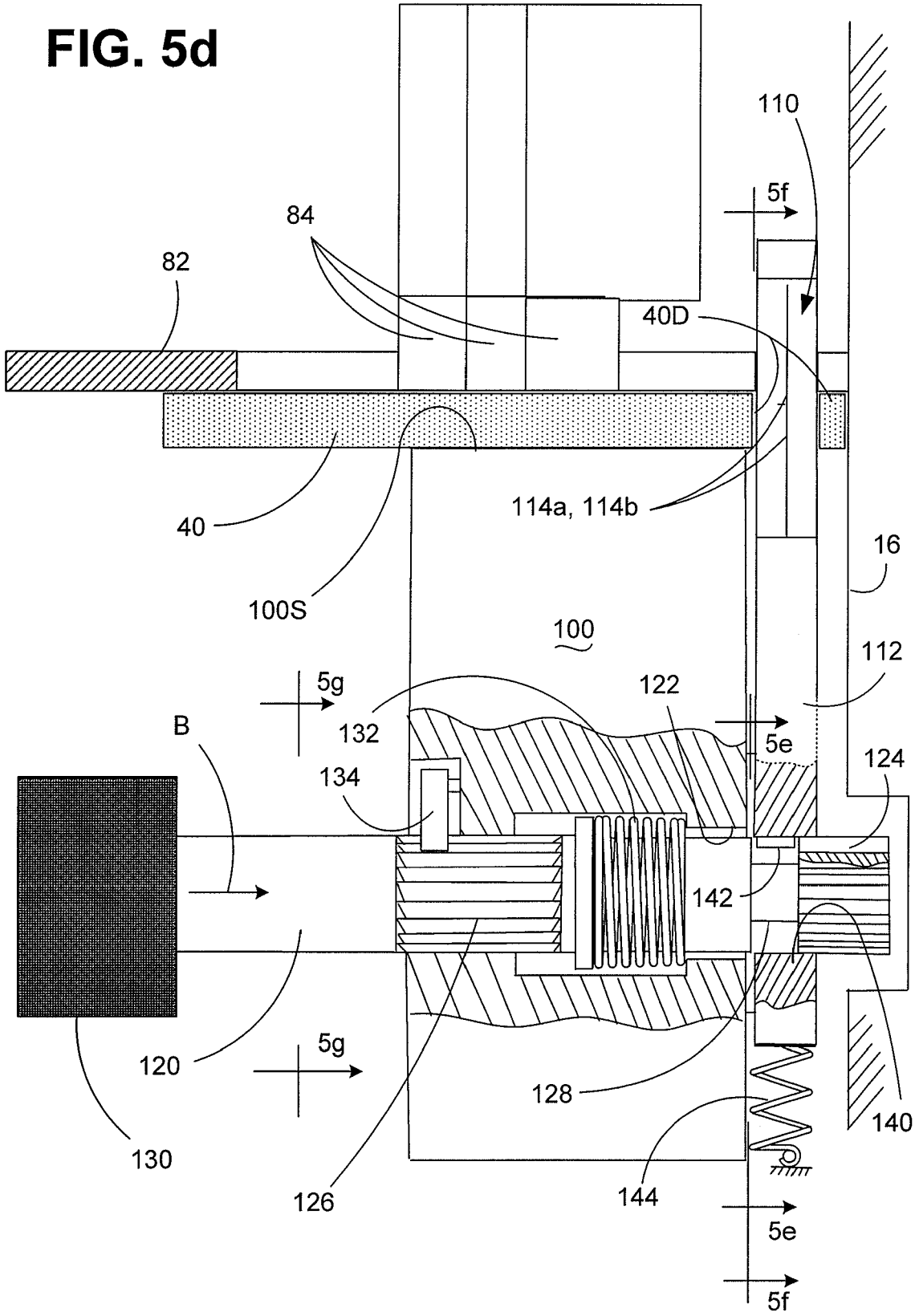
FIG. 5*d* depicts a rear view of the displacement ski and cutting device wherein the actuation shaft is displaced axially thereby causing the key to engage a circumferential groove in the actuation shaft and rotation of the cutting device to its retracted position.
Figure 5E:
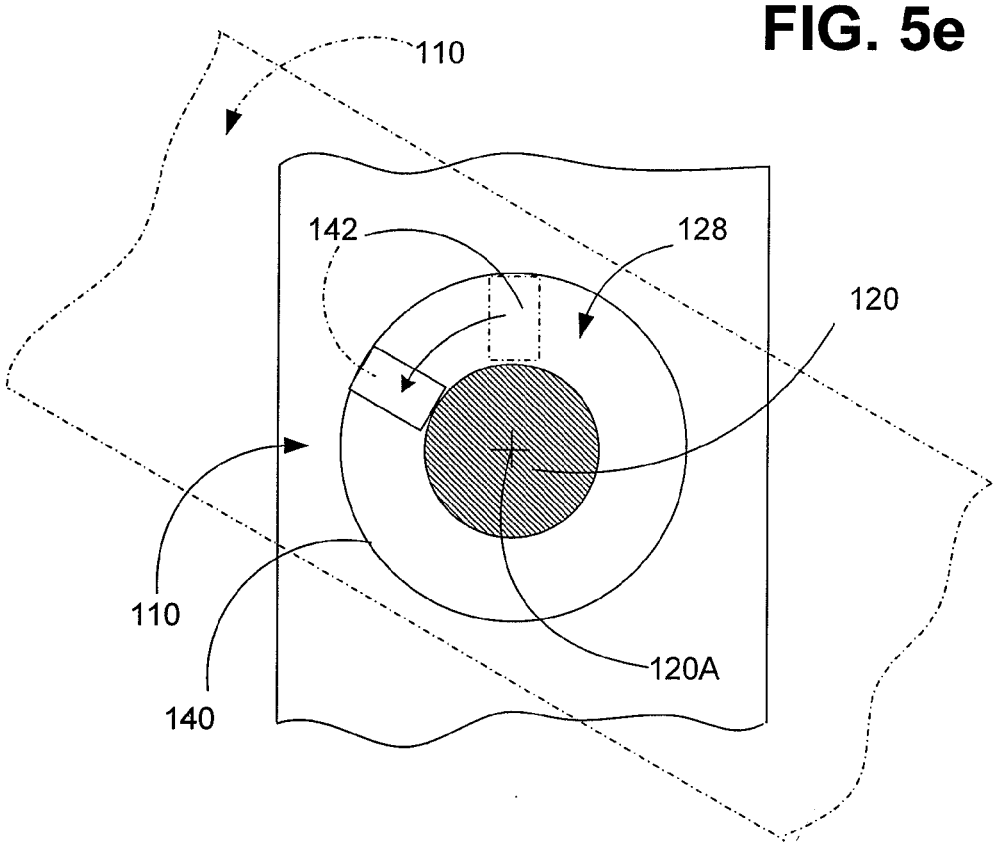
FIG. 5*e* is an enlarged sectional view taken substantially along line 5*e*-5*e* of FIG. 5*d* illustrating the movement of the tooth within the circumferential groove of the actuation shaft.
Figure 5F:
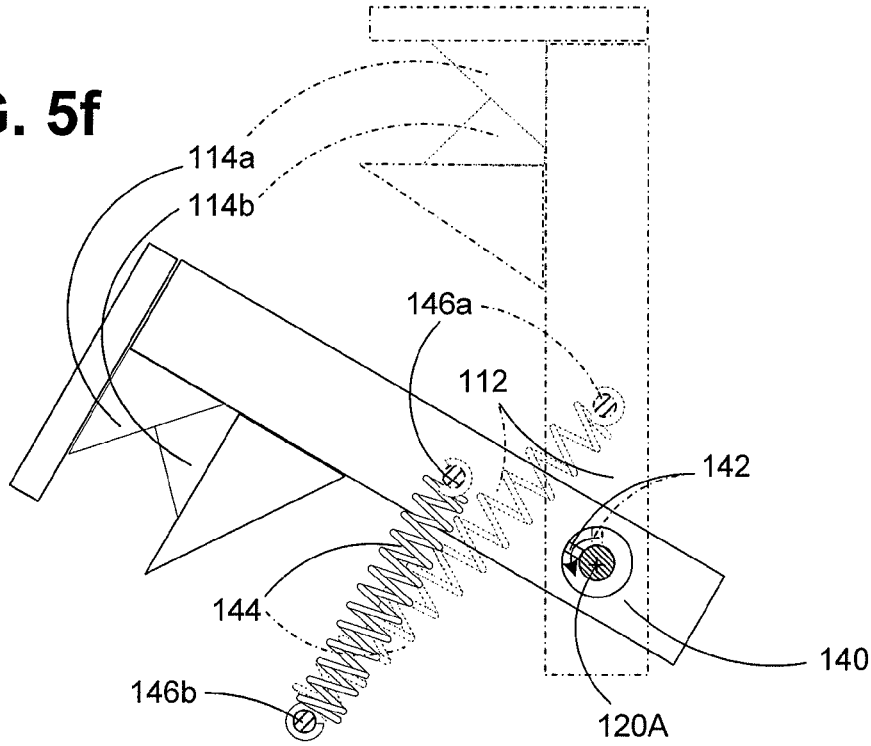
FIG. 5*f* is a sectional view taken substantially along line 5*f*-5*f* of FIG. 5*d* illustrating rotation of the cutting device from its extended to retracted positions.

To return the cutting device 110 to a retracted position, i.e., below the plane of the displacement surface 110S, in FIG. 5*d*, the actuation shaft 120 is axially displaced by depressing the knob 130 against the force of the internal coil spring 132. Axial displacement of the shaft 120, in the direction of Arrow B, causes the aperture key 142 to disengage the axial groove 124 and align with the circumferential groove 128. In FIGS. 5*d*, 5*e* and 5*f*, once the aperture key 142 and rectangular post 112 are disposed in the circumferential groove 128 (see FIG. 5*e*), the cutting device 110 is free to rotate about the axis 120A of the actuation shaft 120. Furthermore, the tension, and consequently moment load, applied by the elongate coil spring 144 causes the cutting device 110 to rotate in a counterclockwise direction and return to its retracted position. The axial load applied by the internal coil spring 132 also causes the aperture key 142 to align with and engage another axial groove 124 about the periphery of the actuation shaft 120. If alignment is not achieved immediately, a slight turn of the actuation shaft 120 will cause the aperture key 142 to with one of the axial grooves 124 (see FIG. 5*b*) at the next angular position/rotational increment.

To re-engage or return the cutting device 110 to its extended position, the actuation shaft 120 is rotated in a clockwise direction. Since the aperture key 142 is engaged with an axial groove 124, the cutting device 110 rotates against the tension load of the elongate coil spring 144. Consequently, the coil spring 144 expands and, once again, begins to apply a moment load to the rectangular post 112. Furthermore, as seen in FIG. 5*g*, the ratchet pawl 134 permits rotation in the direction of Arrow C and is spring loaded to engage a new ratchet tooth 126 with each increment of rotation. Moreover, the ratchet pawl 134 and teeth prevents counter-rotation of the actuation shaft until the cutting device 110 is, once again, in its upright/extended position.

To simplify manufacture and assembly, the displacement ski 100 may be fabricated from a moldable thermoplastic material and the ratchet pawl 134 may be integrally molded into a sidewall structure of the displacement ski 100. Similarly, the actuation shaft 120 may be fabricated from a hardened plastic to simplify the formation of the ratchet teeth 126, annular groove 128, and axial grooves 124.

While the cutting device 110 has been described and illustrated in the context of a manual repositioning mechanism, e.g., an actuation shaft which is rotated and axially depressed manually or by hand, it will be appreciated that the cutting device 110 may be actuated manually, automatically and/or a combination thereof.

Figure 6:
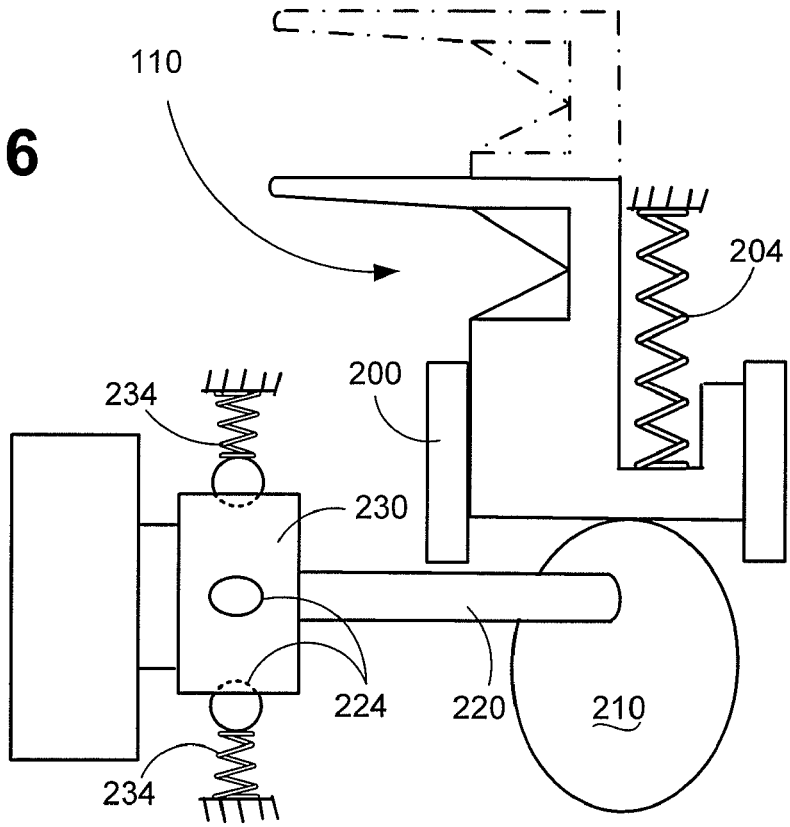
FIG. 6 is a schematic view of an alternate embodiment of the invention wherein the cutting device is mounted within a linear guide and extended/retracted thereby by rotation of a cam actuator.

For example, in FIG. 6 an alternate embodiment of the invention is depicted wherein the cutting device 110 moves linearly within a track or guide 200 of the displacement ski. The repositioning means may include a coil spring 204 for biasing the cutting device 110 downwardly to a retracted position (shown in solid lines in the figure). A camming device 210 may be rotated by an actuation shaft 220 to raise the cutting device 110 to an extended position (shown in dashed lines in the figure). Detents 224 in the actuation shaft 220 or within a cylindrical adapter 230 of the shaft 220 function to retain the position of the shaft 220 as one or more spring-loaded retention balls 234 seat within one of the detents 224.

Figure 7:
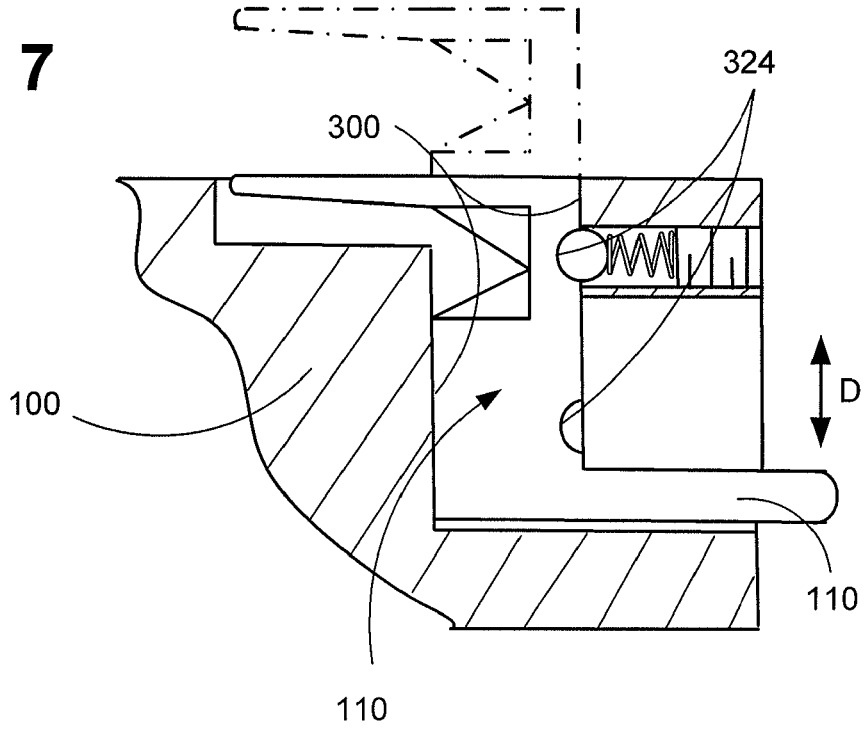
FIG. 7 is a schematic view of an alternate embodiment of the invention wherein the cutting device is mounted within a linear guide and extended/retracted manually to engage detents thereby by rotation of a cam actuator.

In FIG. 7, an alternate embodiment of the invention is depicted wherein the cutting device 110 travels linearly within a track 300 of the displacement ski 100 and includes a lever arm 310 for manually displacing the cutting device 100. That is, the lever arm 310 is accessible for an operator to raise and lower the cutting device 110 from its retracted position (shown in solid lines in FIG. 7) to its extended position (shown in dashed lines in FIG. 7) and vicesa-versa. In the described embodiment, the cutting device 110 includes detents 324 which are operative to engage a spring-loaded retention ball 334 for retaining the position of the cutting device 110.

Figure 8:
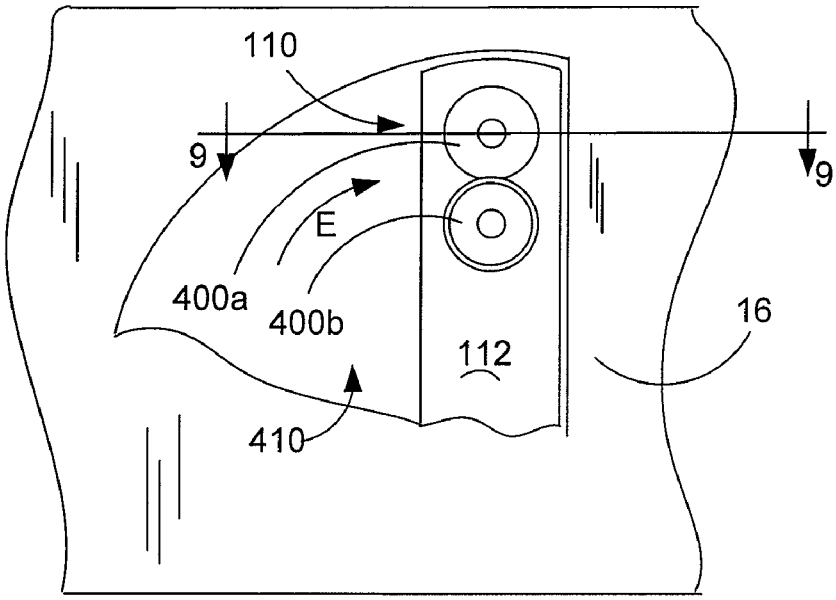
FIG. 8 is a schematic front view of an alternate embodiment of the invention wherein the cutting device includes a pair of cutting wheels mounted to the post or staff of the cutting device.
Figure 9:
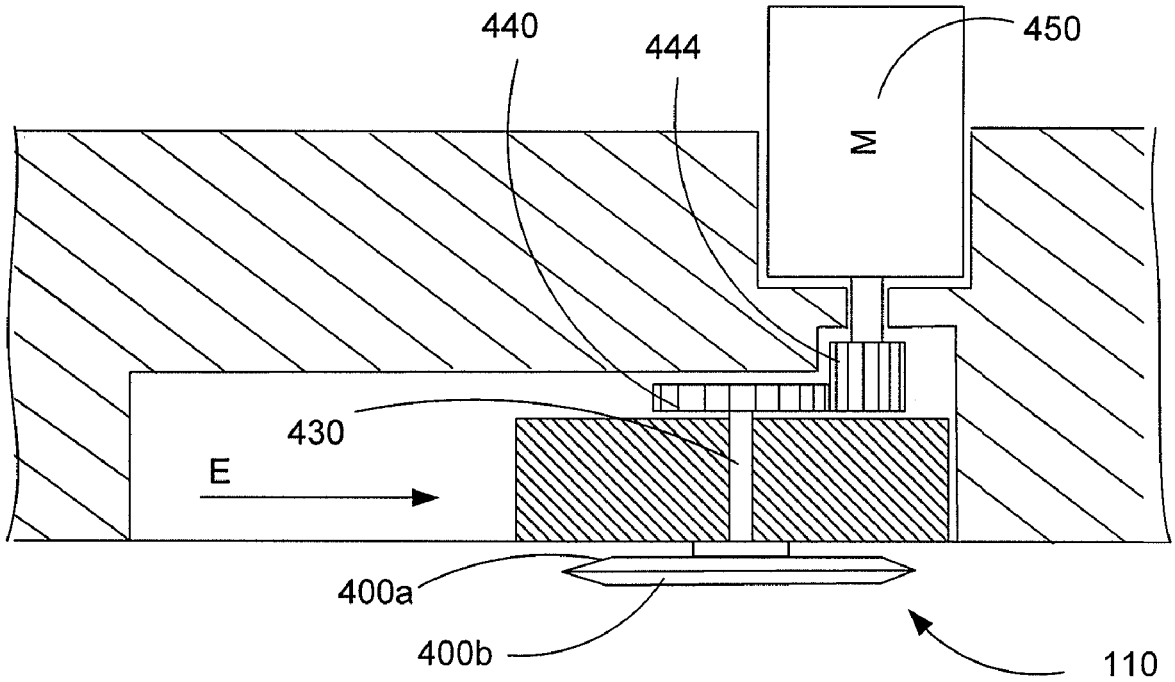
FIG. 9 is a sectional view taken substantially along line 9-9 of FIG. 8 depicting a torque drive interface for driving one of the cutting wheels illustrated in FIG. 8.

While the invention has depicted the cutting device 110 as including staff or post 112 having V-shaped cutting blades 114*a*, 114*b*, it should be appreciated that the cutting device 110 may take a variety of forms. For example, in FIGS. 8 and 9, the cutting device 110 may include a cutting wheel or pair of cutting wheels 400*a*, 400*b* mounted to or alongside the post 112. To ensure proper positioning of the cutting wheels 400*a*, 400*b* relative to the registration wall 16, the post 112 may seat within a recess 410 of the registration wall 16 to ensure that the edge of the mailpiece envelope is cut at the preferred location. In FIG. 9, a torque drive interface 420 is depicted between the at least one cutting wheel 400*a* and a rotary drive mechanism 430. Therein, the cutting wheel 400*a* is connected to a shaft 434 which is rotationally coupled to and driven by a spur gear 440. When the cutting device 110 is rotated in the direction of arrow E, the spur gear 440 mates with a drive gear 444 which is driven by a rotary actuator 450. Consequently, the cutting device 110 becomes active or engaged when rotated to its extended position during cutting operations.

In summary, the invention provides a mailing machine 10 having (i) a displacement ski 100 for preparing the mailpiece surface 40U for printing delivery information and (ii) a cutting device 110 coupled/connected to the displacement ski 100 to cut and open the top edge 40E of the mailpiece envelope. By combining the displacement ski and cutting device 110, the cutting blades 114*a*, 114*b* thereof follow the vertical location of the displacement surface 100S to ensure accurate positioning of the blades 114*a*, 114*b* when opening the mailpiece, i.e., irrespective the mailpiece thickness. Furthermore, print operations may continue for printing mailpiece receipt information, e.g., date, time and/or location information, even when the cutting device 110 is operational, i.e., in its extended position.

While preferred embodiments of the invention have been described and illustrated above, it should be understood that these are exemplary of the invention and are not to be considered as limiting. Additions, deletions, substitutions, and other modifications can be made without departing from the spirit or scope of the present invention. Accordingly, the invention is not to be considered as limited by the foregoing description but is only limited by the scope of the appended claims.

What is claimed is:

1. A mailing machine for printing and opening mailpieces, the mailpieces being conveyed along a processing path, comprising:

a displacement device having a displacement surface for urging mailpieces against a registration surface, a retractable cutting device coupled to the displacement device for cutting the mailpiece in a direction substantially parallel to the processing path of the mailpiece, means for positioning the cutting device relative to the displacement surface such that in a first operating mode, the cutting device is retracted beneath a plane defined by the displacement surface to facilitate the print operations, and in a second operating mode, the cutting device is extended above the plane defined by the displacement surface to facilitate cutting operations along an edge thereof, and wherein the displacement device includes a displacement ski pivot mounted to a stationary structure of the mailing machine and is rotationally biased to pivot the displacement ski into contact with the underside of the mailpiece, and wherein the cutting device is pivot mounted to the displacement ski and rotated into retracted and/or extended positions relative to the displacement surface.

2. The mailing machine according to claim 1 further comprising a registration plate defining an opening therein and a plurality of print heads disposed over the registration plate and through the opening, the print heads operative to print delivery information in the first operating mode, and to print mailpiece receipt information in the second operating mode.

3. The mailing machine according to claim 2 wherein the mailpiece delivery information includes a postage indicia.

4. The mailing machine according to claim 2 wherein the mailpiece delivery information includes a destination address.

5. The mailing machine according to claim 2 wherein the mailpiece delivery information includes a return address.

6. The mailing machine according to claim 2 wherein the mailpiece receipt information includes a date of opening.

7. The mailing machine according to claim 2 wherein the mailpiece delivery information includes a postage indicia and the mailpiece opening information includes a date of opening.

8. The mailing machine according to claim 2 wherein the mailpiece receipt information includes a time of opening.

9. The mailing machine according to claim 1 wherein the displacement device is a displacement ski pivot mounted to a stationary structure of the mailing machine and is rotationally biased to pivot the displacement ski into contact with the underside of the mailpiece, the displacement device having a guide track formed therein, and wherein the cutting device engages the guide track to linearly raise and lower the cutting device relative to the displacement surface.

10. The mailing machine according to claim 9 wherein the cutting device includes a pair of V-shaped cutting blades.

11. The mailing machine according to claim 9 wherein the cutting device includes an actuation arm for manually positioning the cutting device relative to the displacement surface.

12. The mailing machine according to claim 9 wherein the cutting device includes a pair of cutting wheels.

13. The mailing machine according to claim 1 wherein the cutting device includes a pair of V-shaped cutting blades.

14. The mailing machine according to claim 1 wherein the cutting device includes a pair of cutting wheels.

15. The mailing machine according to claim 14 wherein at least one of the cutting wheels is driven by a rotary drive mechanism.

16. The mailing machine according to claim 15 further including a torque drive interface between the at least one cutting wheel and the rotary drive mechanism and wherein the torque drive interface engages when the cutting device is extended during cutting operations.

* * * * *